US007303316B2

(12) United States Patent
Liu

(10) Patent No.: US 7,303,316 B2
(45) Date of Patent: Dec. 4, 2007

(54) CAR LAMP STRUCTURE

(76) Inventor: Mei-Chen Liu, No. 31, Alley 34, Lane 38, Guangsing St., Yongkang City, Tainan County (TW)

( * ) Notice: Subject to any disclaimer, the term of this patent is extended or adjusted under 35 U.S.C. 154(b) by 163 days.

(21) Appl. No.: 11/213,691

(22) Filed: Aug. 30, 2005

(65) Prior Publication Data

US 2007/0081351 A1 Apr. 12, 2007

(51) Int. Cl.
*F21V 7/00* (2006.01)

(52) U.S. Cl. ..... 362/297; 362/348; 362/518

(58) Field of Classification Search ..... 362/290, 362/291, 297, 307, 310, 517, 519, 509, 516, 362/518, 487, 311, 351, 346, 520, 521, 522, 362/328, 329, 331, 800, 332, 336, 348
See application file for complete search history.

(56) References Cited

U.S. PATENT DOCUMENTS 1,764,474 A * 6/1930 Shippee ..... 362/309
2,141,159 A * 12/1938 Bergstrom ..... 359/528
3,153,168 A * 10/1964 Saranga ..... 313/113
5,373,423 A * 12/1994 Liedtke et al. ..... 362/510
5,580,156 A * 12/1996 Suzuki et al. ..... 362/184
5,692,824 A * 12/1997 Ooishi ..... 362/517
6,109,772 A * 8/2000 Futami et al. ..... 362/518
6,152,589 A * 11/2000 Kawaguchi et al. ..... 362/518
6,168,293 B1 * 1/2001 Lieszkovszky et al. ..... 362/297
6,244,731 B1 * 6/2001 Koiko et al. ..... 362/297
6,367,949 B1 * 4/2002 Pederson ..... 362/240
6,578,997 B2 * 6/2003 Futami ..... 362/522
2002/0067548 A1 * 6/2002 TerHovhannisian ..... 359/627
2004/0095763 A1 * 5/2004 Guerrieri et al. ..... 362/240
2004/0145908 A1 * 7/2004 Ognian et al. ..... 362/516
2005/0036326 A1 * 2/2005 Van Duyn ..... 362/475
2006/0227566 A1 * 10/2006 Lee ..... 362/509

* cited by examiner

*Primary Examiner*—Jong-Suk (James) Lee
*Assistant Examiner*—Edmund Kang
(74) *Attorney, Agent, or Firm*—Rosenberg, Klein & Lee

(57) ABSTRACT

A car lamp includes a lamp shell, a reflecting shade ahead of the lamp shell, a bulb on the reflecting shell, a set-off member ahead of the reflecting shade, and a pervious-to-light lamp cover secured ahead of the set-off member; the reflecting shade has several reflecting surfaces; the set-off member has a pervious-to-light cover on a middle portion, several concave portions around the pervious-to-light cover, through holes respectively connected to rear ends of the concave portions and faced with the reflecting surfaces of the reflecting shade; the set-off member further has several reflecting surfaces on each of inner sides of the concave portions, and several pervious-to-light plates respectively fitted in the through holes thereof; therefore, when the bulb shines, the whole car lamp will look like it has several light emitting diodes shining therein.

1 Claim, 4 Drawing Sheets

CAR LAMP STRUCTURE

BACKGROUND OF THE INVENTION

1. Field of the Invention

The present invention relates to a car lamp, more particularly one, which is equipped with a set-off member having several through concave portions, several reflecting surfaces on each of inner sides of the concave portions, and pervious-to-light plates respectively positioned behind the concave portions such that when a bulb of the lamp shines, the whole car lamp will look like it has several light emitting diodes shining therein.

2. Brief Description of the Prior Art

A conventional car lamp includes a lamp shell, a reflecting shade in front of the lamp shell, a bulb on a front side of the reflecting shade, and a pervious-to-light lamp cover secured in front of the bulb and the reflecting shade. The pervious-to-light lamp cover can be red, yellow or colorless, and light emitted from the car lamp will be the same color as the pervious-to-light lamp cover; the car lamp can be used as a warning light if the lamp cover is red; the car lamp can be used as a blinker if the lamp cover is yellow; the car lamp can be used as a back-up light if the lamp cover is colorless.

However, when the bulb shines, such car lamp will only produce monotonous light obviously from single light source. Consequently, such car lamp is much less popular than those with several light emitting diodes (LED) therein.

SUMMARY OF THE INVENTION

It is a main object of the invention to provide an improvement on a car lamp to overcome the above-mentioned problem. The car lamp of the present invention includes a lamp shell, a reflecting shade ahead of the lamp shell, a bulb on the reflecting shell, a set-off member ahead of both the bulb and the reflecting shade, and a pervious-to-light lamp cover secured ahead of the set-off member. The reflecting shade has several reflecting surfaces. The set-off member has a pervious-to-light cover on a middle portion thereof, several concave portions around the pervious-to-light cover, through holes respectively connected to rear ends of the concave portions and faced with the reflecting surfaces of the reflecting shade. The set-off member further has several reflecting surfaces on each of inner sides of the concave portions, and several pervious-to-light plates respectively fitted in the through holes thereof. Therefore, when the bulb shines, the whole car lamp will look like it has several light emitting diodes shining therein.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
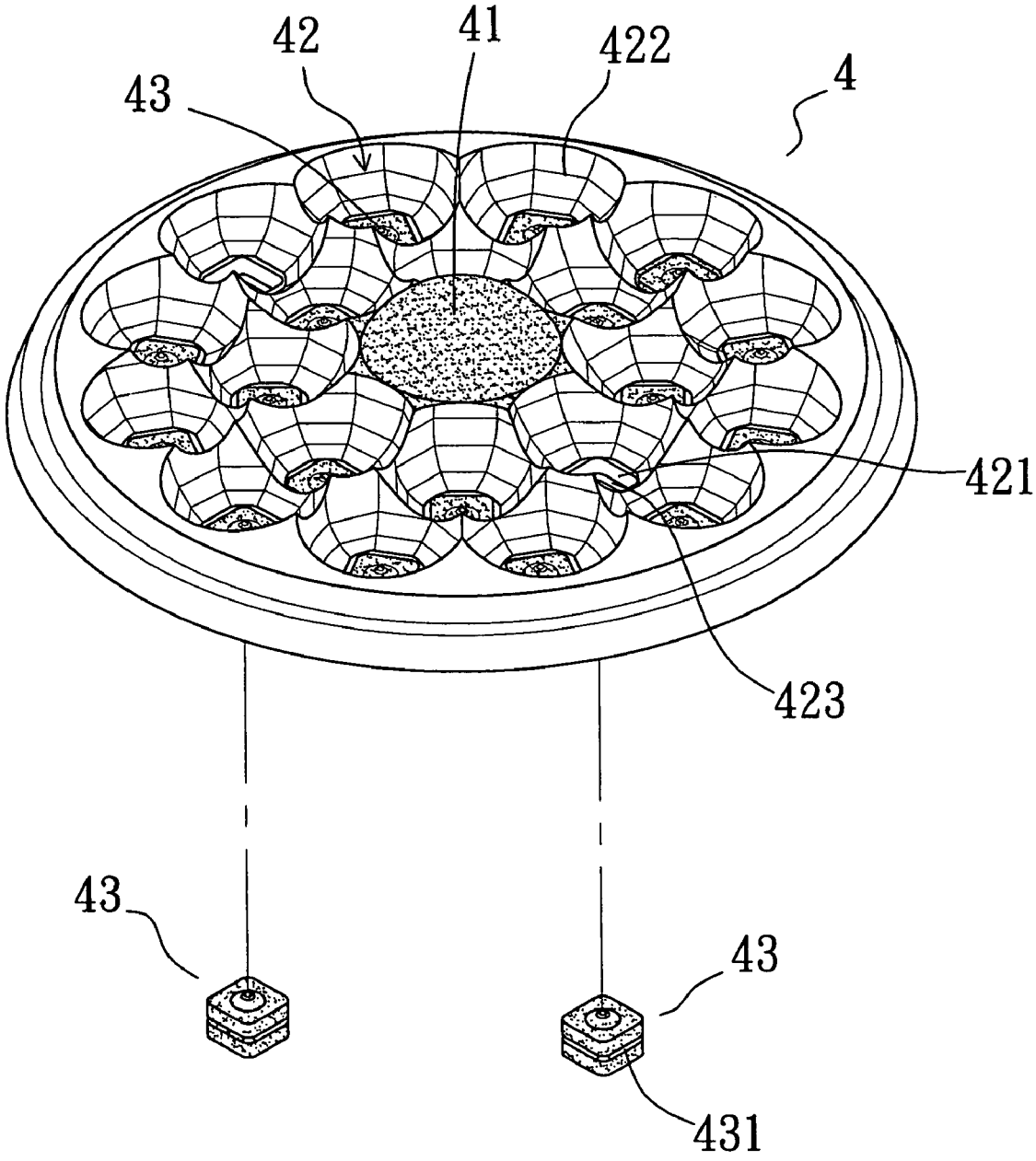
FIG. 1 is an exploded perspective view of the car lamp according to the present invention.
Figure 2:
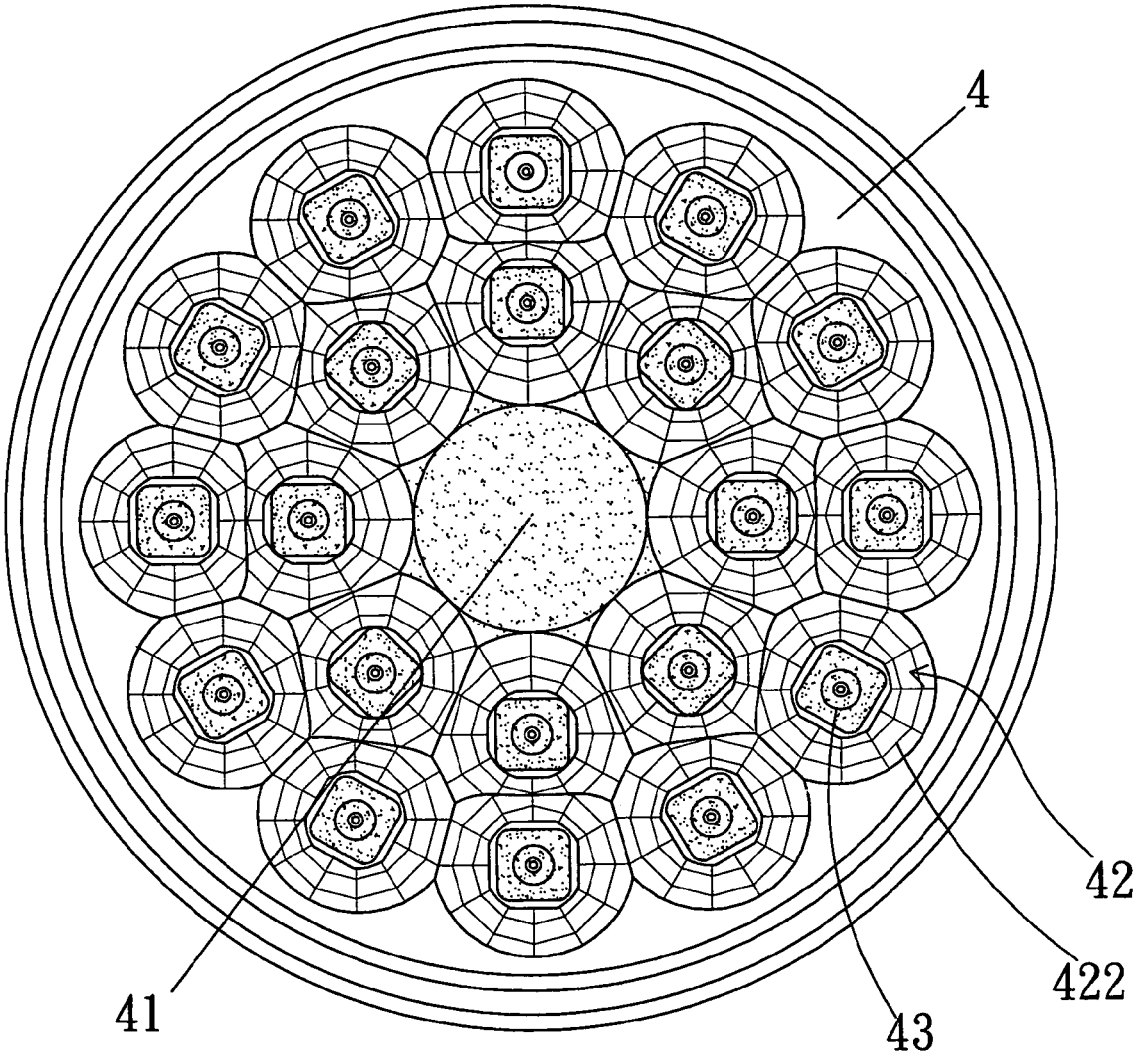
FIG. 2 is a front view of the car lamp of the invention.
Figure 3:
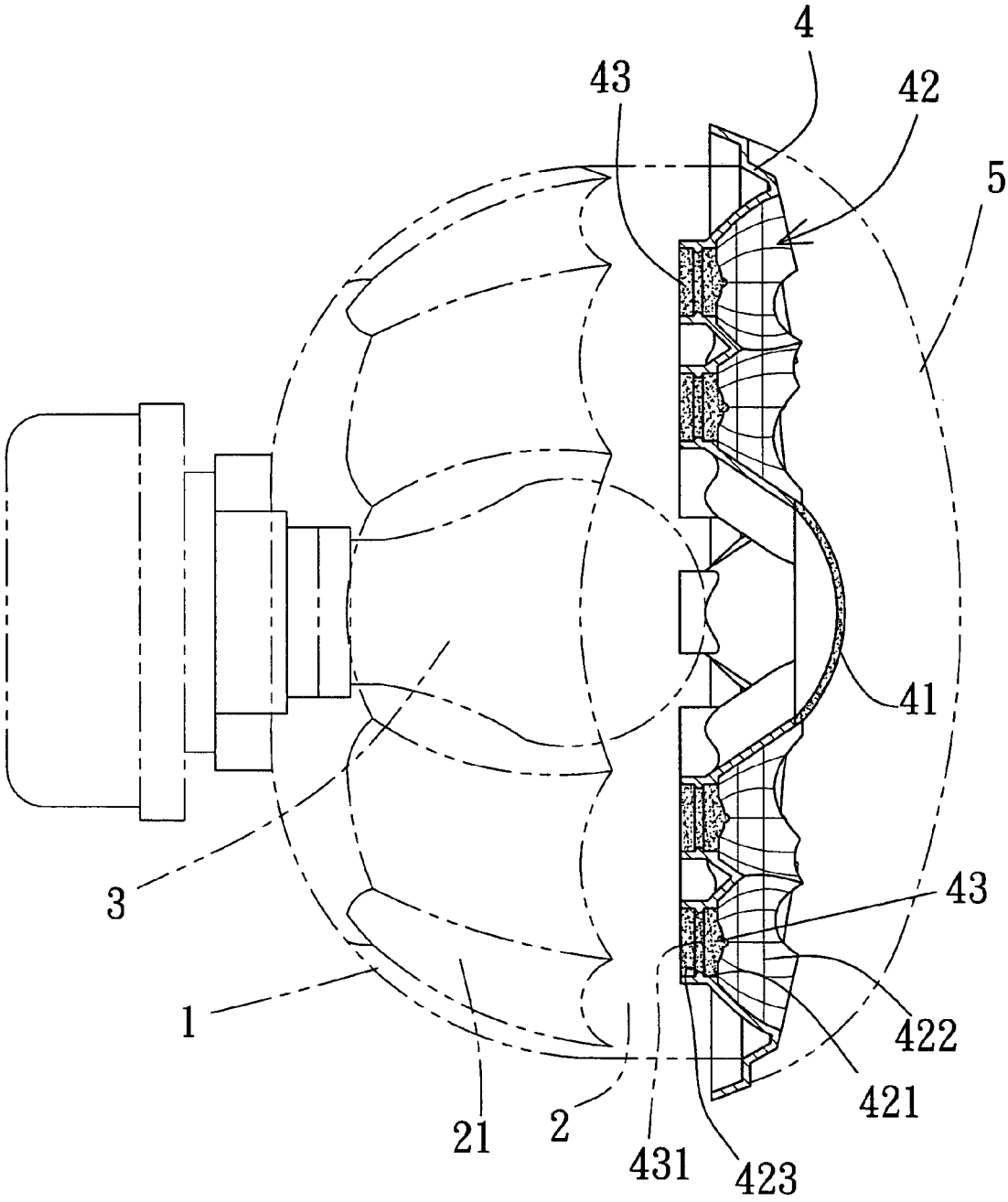
FIG. 3 is a side view of the car lamp of the invention.

Referring to FIGS. 1 to 3, a preferred embodiment of a car lamp of the present invention includes a lamp shell 1 on a rear side, a reflecting shade 2 in front of the lamp shell 1, a bulb 3 on a front side of the reflecting shade 2, a set-off member 4, and a pervious-to-light lamp cover 5.

The reflecting shade 2 has several reflecting surfaces 21 on the front side thereof. The set-off member 4 is positioned in front of both the reflecting shade 2 and the bulb 3 and has a pervious-to-light cover 41 and multiple reflecting elements. The pervious-to-light cover 41 is mounted on a middle portion of the set-off member 4 to cover the bulb 3. Each reflecting element is mounted on a front side of the set-off member 4 and around the pervious-to-light cover 41 and has a concave portion 42, a through hole 421, a reflecting surface 422 and a pervious-to-light plate 43. The through holes 421 are respectively formed through rear ends of the concave portions 42 and face the reflecting surfaces 21 of the reflecting shade 2 such that light reflected by each of the reflecting surfaces 21 will travel through the corresponding through hole 421 and concave portion 42. The concave portions 42 are in the shape of a bowl. The set-off member 4 has an engaging portion 423 in each of the through holes 421, and many reflecting surfaces 422 on each of inner sides of the concave portions 42. The set-off member 4 further has pervious-to-light plates 43, each of which has an engaging recess 431 on an outer side. The pervious-to-light plates 43 are respectively fitted in the through holes 421 with the engaging portions 423 being fitted in the engaging recesses 431 thereof. The pervious-to-light lamp cover 5 is secured in front of the set-off member 4.

Therefore, when the bulb 3 shines, some of the light from the bulb will travel through the pervious-to-light cover 41 of the set-off member 4 directly, and the rest of the light will be reflected by the reflecting surfaces 21 of the reflecting shade 2, and travel outside the car lamp through the through holes 421 and the concave portions 42 of the set-off member 4; the reflecting surfaces 422 the concave portions 42 will reflect the light traveling through the concave portions 42 in such a way that the whole car lamp looks like it has several light emitting diodes (LED) shining therein.

The pervious-to-light lamp cover 41 and the pervious-to-light plates 43 of the set-off member 4 can be red, yellow or colorless; the car lamp can be used as a warning light if the pervious-to-light cover 41 and the pervious-to-light plates 43 are red; the car lamp can be used as a blinker if the pervious-to-light cover 41 and the pervious-to-light plates 43 are yellow; the car lamp can be used as a back-up light if the pervious-to-light cover 41 and the pervious-to-light plates 43 are colorless.

Figure 4:
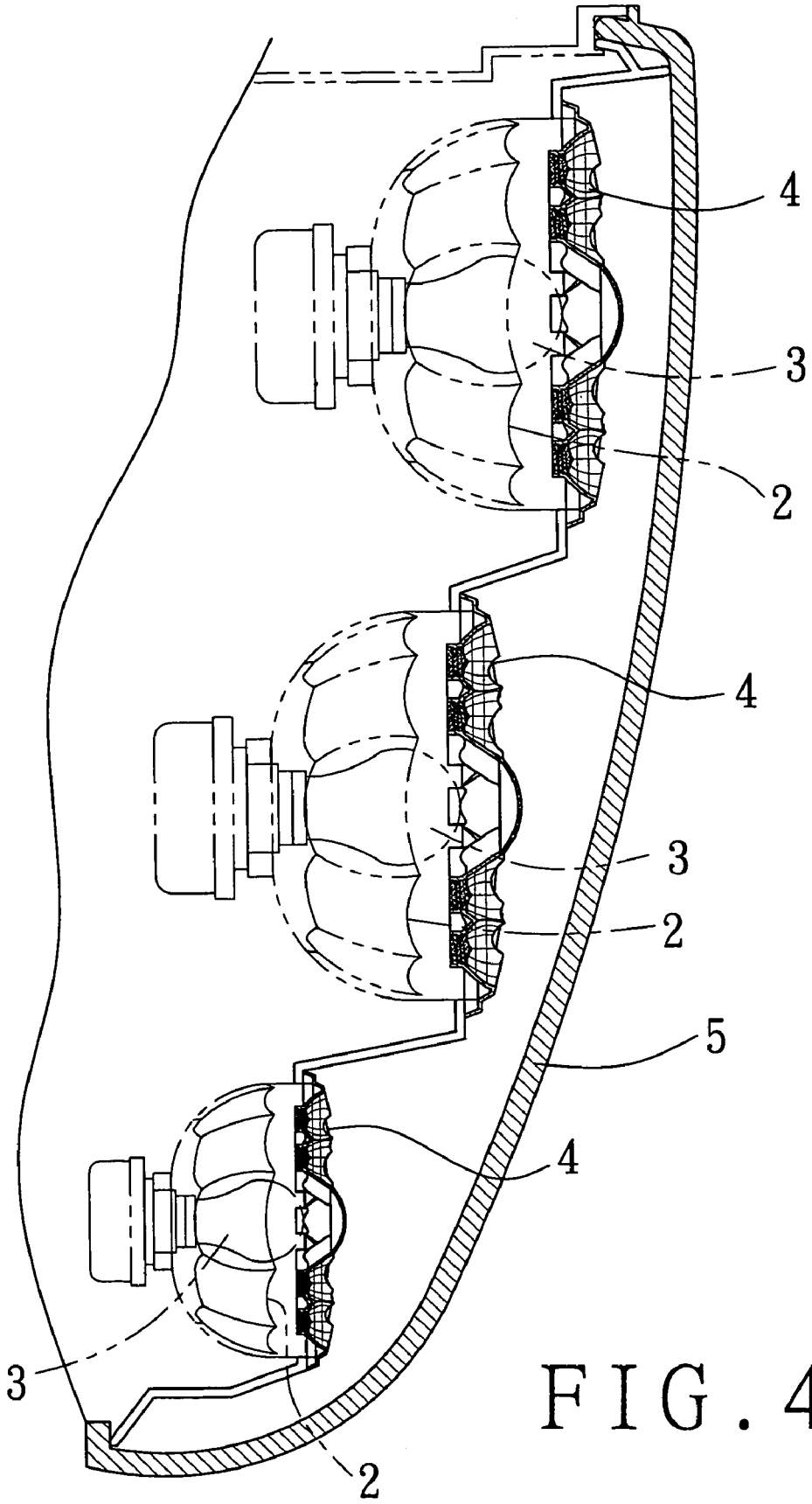
FIG. 4 is a view of the second preferred embodiment.

Furthermore, referring to FIG. 4, a second preferred embodiment of a car lamp of the invention is comprised of several lamps of the above structure, which are used as a warning light, a blinker, and a back-up light respectively.

From the above description, it can be easily seen that when the bulb is powered, the car lamp of the present invention will look like it has several light emitting diodes shining therein because of the set-off member thereof.

What is claimed is:

1. A car lamp structure comprising:

a lamp shell;

a reflecting shade mounted within the lamp shell;

a bulb mounted within the reflecting shade, the reflecting shade having a plurality of reflecting surfaces disposed on a side of the reflecting shade facing the bulb;

a set-off member positioned forward of the reflecting shade and the bulb and having a middle portion, a pervious-to-light cover mounted on the middle portion, a front side facing away from the bulb, and a plurality of reflecting elements mounted on the front side of the set-off member around the pervious-to-light cover, each reflecting element having:

a concave portion having an end facing the reflecting surfaces of the reflecting shade and an inner side facing away from the reflecting surfaces of the reflecting shade, a through hole formed through the end of the concave portion and facing the reflecting surfaces of the reflecting shade, a plurality of reflecting surfaces covering the inner side of the concave portion, and a pervious-to-light plate fitted in the through hole; and a pervious-to-light lamp cover secured forward of the set-off member.

* * * * *